US006174141B1

(12) United States Patent
Song et al.

(10) Patent No.: US 6,174,141 B1
(45) Date of Patent: Jan. 16, 2001

(54) STRUCTURE FOR COUPLING MUFFLER FOR LINEAR COMPRESSOR

(75) Inventors: Gye-Young Song, Kwangmyung; Hyeong-Kook Lee, Kunpo; Hyung-Jin Kim, Seoul, all of (KR)

(73) Assignee: LG Electronics Inc. (KR)

( * ) Notice: Under 35 U.S.C. 154(b), the term of this patent shall be extended for 0 days.

(21) Appl. No.: 09/229,029

(22) Filed: Jan. 12, 1999

(30) Foreign Application Priority Data

Jan. 12, 1998 (KR) ..... 98/572
Jun. 22, 1998 (KR) ..... 98/23438
Dec. 17, 1998 (KR) ..... 98/55702

(51) Int. Cl.[7] ..... F04B 53/12
(52) U.S. Cl. ..... 417/312; 417/417
(58) Field of Search ..... 417/312, 416, 417/417, 542

(56) References Cited

U.S. PATENT DOCUMENTS 3,171,585 * 3/1965 Gauss ..... 417/417
3,813,192 * 5/1974 Adams et al. ..... 417/416
4,121,125 * 10/1978 Dölz ..... 417/416 X
4,374,330 * 2/1983 Fey ..... 417/417 X
4,632,645 * 12/1986 Kawakami et al. ..... 417/417
5,704,771 * 1/1998 Fujisawa et al. ..... 417/417
5,993,178 * 11/1999 Park et al. ..... 417/416 X

* cited by examiner

*Primary Examiner*—Timothy S. Thorpe
*Assistant Examiner*—David J. Torrente
(74) *Attorney, Agent, or Firm*—Ostrolenk, Faber, Gerb & Soffen, LLP

(57) ABSTRACT

A structure for coupling a muffler for a linear compressor is disclosed. The structure includes a muffler including a hallow cylindrical inlet portion, and a contact portion having a predetermined area wherein one end of the inlet portion is outwardly and vertically curved, whereby one end of the inlet portion is inserted into a gas flow path of a piston, and one end of the contact portion contacts with an inner surface of the cover, and an elastic support member disposed between an inner surface of the cover and a side surface of an inner lamination for supporting one end of the muffler, for thereby stably fixing the muffler to the piston without using an additional coupling member.

18 Claims, 7 Drawing Sheets

STRUCTURE FOR COUPLING MUFFLER FOR LINEAR COMPRESSOR

BACKGROUND OF THE INVENTION

1. Field of the Invention

The present invention relates to a structure for coupling a muffler for a linear compressor, and in particular to an improved structure for coupling a muffler for a linear compressor which is capable of implementing an easier fabrication, preventing a friction noise generated between elements when a piston reciprocates by obtaining a stable coupling between the elements, and preventing any deformation in the radial direction of a spring which elastically supports the piston and fixes a muffler to the piston.

2. Description of the Conventional Art

Generally, a compressor which forms a refrigerating cycle apparatus such as an evaporator, an accumulator, etc. includes a driving force generator, which is a machine for compressing gases such as air or refrigerant based on a rotation movement of a vane or a rotor or a reciprocating movement of a piston, for driving the vane, rotor, and piston, and a compression mechanism unit for sucking and compressing the gas based on the driving force transferred from the driving force generator.

The thusly constituted compressor is classified into a hermetic type and a separation type based on the installation type of the driving force generator and the compression mechanism unit. Of which, in the hermetic type, the driving force generator and the compression mechanism unit are installed in a predetermined shaped hermetic container, and in the separation type, the driving force generator is installed outside the hermetic container, so that a driving force generated by the driving force generator is applied to the compression mechanism unit in the hermetic container.

The hermetic type compressor is classified into a rotary type, a reciprocating type, a linear type and a scroll type in accordance with the structure for compressing gas. Recently, the user of the linear compressor is increased due to its characteristic that the piston is directly reciprocated using a magnet and coil without using a crank shaft in order to overcome various problems of the compressor which is designed to use the crank shaft.

As shown in FIG. 1, in the linear compressor, a hallow cylindrical inner casing 2 with its both ends being opened is installed in the interior of a hallow cylindrical hermetic container 1. A semi-circular cover 10 having a suction hole 10*a* formed at its center portion is covered at one end of the inner casing 2. A semicircular cover plate 3 having a through hole (not shown) formed at its center portion is covered at the other end of the inner casing 2. A cylindrical cylinder 4 is inserted into the through hole of the cover plate 3, and an exhaust valve assembly 13 and a head cover 14 are engaged to an end portion of the cylinder 4 for thereby discharging a compressed refrigerant gas.

In addition, in the interior of the inner casing is installed a linear motor comprising an outer lamination 5 fixed to an inner wall of the inner casing 2 in a circular form, a circular inner lamination 6 fixedly inserted into an outer surface of the cylinder 4, a hallow cylindrical first magnet paddle 7 with its both ends being disposed between the laminations 5 and 6, and a second magnet paddle 8 covering one end of the first magnet paddle 7. One end of the piston 9 is fixed at the center portion of the inner surface of the second magnet paddle 8 of the linear motor so that the same is reciprocated within the cylinder 4. When a power is supplied, the first magnet paddle 7 reciprocates between the laminations 5 and 6 at a high speed by the magnetic force induced between the laminations 5 and 6, so that the piston 9 is moved for thereby compressing the refrigerant gas sucked.

In addition, the piston 9 includes a cylindrical piston body 9*a* having a gas path F formed therein, and a support portion 9*b* extended from the end portion of the piston body 9*a* and having a predetermined area. A plurality of engaging holes (not shown) are formed at the support portion 9*b*, so that the piston 9 is engaged with the second magnet paddle 8 by an engaging bolt (not shown).

In addition, an inner side coil spring 11 is installed between an inner surface of the inner lamination 6 and an inner surface of the second magnet paddle 8, and an outer coil spring 12 is installed between an outer surface of the second magnet paddle 8 and an inner surface of the cover 10 for thereby elastically supporting the piston 9 when the piston 9 reciprocates within the cylinder 4 in association with the first and second magnet paddles of the linear motor for thereby generating and storing a kinetic energy.

Here, the support structure of the inner and outer side coil springs 11 and 12 will be explained.

As shown in FIG. 2, in the spring support structure for a conventional linear compressor, a first support plate 17 having a rim portion 17*b* perpendicularly curved to have an inner diameter corresponding to an outer diameter of the outer coil spring 12 at the rim portion of a circular plate portion 17*a* having a predetermined thickness is engaged at the inner side center portion of the cover 10. A second support plate 18 having a rim portion 18*b* perpendicularly curved to have an inner diameter larger than an outer diameter of the outer coil spring 12 at the rim portion of the circular plate portion 18*a* having a predetermined thickness is engaged at an outer surface of the second magnet paddle 8. A third support plate 19 having a rim potion 19*b* perpendicularly curved to have an inner diameter larger than an outer diameter of the inner coil spring 11 at the rim portion of the circular plate portion 19*a* having a predetermined thickness is engaged at the inner surface of the second magnet paddle 8. A fourth support plate 20 having a rim portion 20*b* perpendicularly curved to have an inner diameter corresponding to an outer diameter of the inner coil spring 11 at the rim portion of the circular plate having a predetermined thickness is engaged at a surface of the inner lamination 6. The outer coil spring 12 is disposed between the first support plate 17 and the second support plate 18. The inner coil spring 11 is disposed between the third support plate 19 and the fourth support plate for thereby elastically supporting the piston 9.

At this time, the outer coil spring 12 has its one end fixed to the first support plate 17 and its another end loosely supported by the second support plate 18. The inner coil spring 11 has its one end loosely supported by the third support plate 19, and its another end fixed to the fourth support plate 20.

In the drawings, reference numeral 16 represents an oil supply apparatus, and 1*a* represents a suction tube.

The operation of the conventional linear compressor will be explained with reference to the accompanying drawings.

Namely, in the conventional linear compressor, when a current is applied to the linear motor, a magnetic force is induced between the inner lamination 6 and the outer lamination 5. Therefore, the first magnet paddle 7 reciprocates between the laminations 5 and 6 at a high speed. The second magnet paddle 8 covering one end of the first magnet paddle 7 is activated, and the piston 9 connected with the inner center portion of the second magnet paddle 8 reciprocates within the interior of the cylinder 4. The refrigerant gas sucked into the hermetic container 1 is sucked into a compression space P of the cylinder 4 through the gas flow path F formed in the interior of the piston 9, and then is compressed therein. The thusly compressed gas is exhausted through the exhaust valve assembly 13 and the head cover 14.

At this time, the refrigerant gas introduced into the hermetic container 1 is fully filled into the interior of the hermetic container 1. When the piston 9 reciprocates, the gas is sucked into the compression space P formed in the interior of the cylinder 4 along the gas flow path F of the piston 9 and then is compressed and exhausted in the compression cycle of the piston 9. During the compression of the refrigerant gas, the exhaust valve assembly 13 is opened/closed by the pressure difference between the compression space P and the exhaust space D for thereby generating noises. The thusly generated noises are applied through the gas flow path F of the piston 9 and then spread to the outside of the inner casing 2 for thereby generating a compressor noise.

Therefore, in order to overcome the above-described noise problem, in the conventional linear compressor, a muffler is fixed based on a predetermined shape coupling structure for preventing the noise generated in the gas flow path of the piston 9.

As shown in FIG. 3, in the muffle coupling structure for a conventional linear compressor, a muffler 30 is disposed from the suction portion of the cover 10 to the gas flow path of the piston 9. End portions of the muffler 30 are fixed at the portions of the refrigerant gas suction portion 10*a* of the cover 10 for thereby preventing any movement of the same.

However, in the muffler coupling structure for a conventional linear compressor, an engaging member B and engaging hole (not shown) are additionally needed for coupling the muffler 30 to the cover 10 for thereby increasing the fabrication cost and the number of fabrication processes, so that the productivity is decreased.

In addition, since the inner and outer coil springs 11 and 12 elastically supporting the piston when the piston 9 reciprocates are loosely supported by the second and third support plates 18 and 19 formed on the inner and outer surfaces of the second magnet paddle 8, as shown in FIGS. 4A and 4B, a radial eccentric deformation may occur in the spring during the contracting and expanding process of the spring as the piston 9 reciprocates. Therefore, a rotation moment may occur in the piston 9 due to the eccentric deformation of the spring, so that a friction occurs between the inner surfaces of the piston 9 and the cylinder 4 resulting in an abrasion between the friction elements.

SUMMARY OF THE INVENTION

Accordingly, it is an object of the present invention to provide a structure for coupling a muffler for a linear compressor which overcomes the problems encountered in a conventional art.

It is another object of the present invention to provide a structure for coupling a muffler for a linear compressor which is capable of stably fixing the muffler to the piston without using an additional coupling member.

It is another object of the present invention to provide a structure for coupling a muffler for a linear compressor which is capable of implementing an easier assembling and fabrication of the system and preventing a friction noise between elements by maintaining a stable coupling state.

It is another object of the present invention to provide a structure for coupling a muffler for a linear compressor in which an eccentric deformation does not occur in the inner and outer coil springs which elastically support the piston during a reciprocation operation of the piston when the springs are contracted and expanded.

To achieve the above objects, there is provided a structure for coupling a muffler for a linear compressor according to a first embodiment of the present invention which includes a muffler including a hallow cylindrical inlet portion, and a contact portion having a predetermined area wherein one end of the inlet portion is outwardly and vertically curved, whereby one end of the inlet portion is inserted into a gas flow path of a piston, and one end of the contact portion contacts with an inner surface of the cover, and an elastic support member disposed between an inner surface of the cover and a side surface of an inner lamination for supporting one end of the muffler.

To achieve the above objects, there is provided a structure for coupling a muffler for a linear compressor according to a second embodiment of the present invention which includes a first muffler inserted into a gas flow path of a piston, a second muffler engaged with a cover, and an elastic support member for elastically supporting the movement of the piston and fixing the first and second coupling portions of first and second mufflers to a support portion of the piston.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
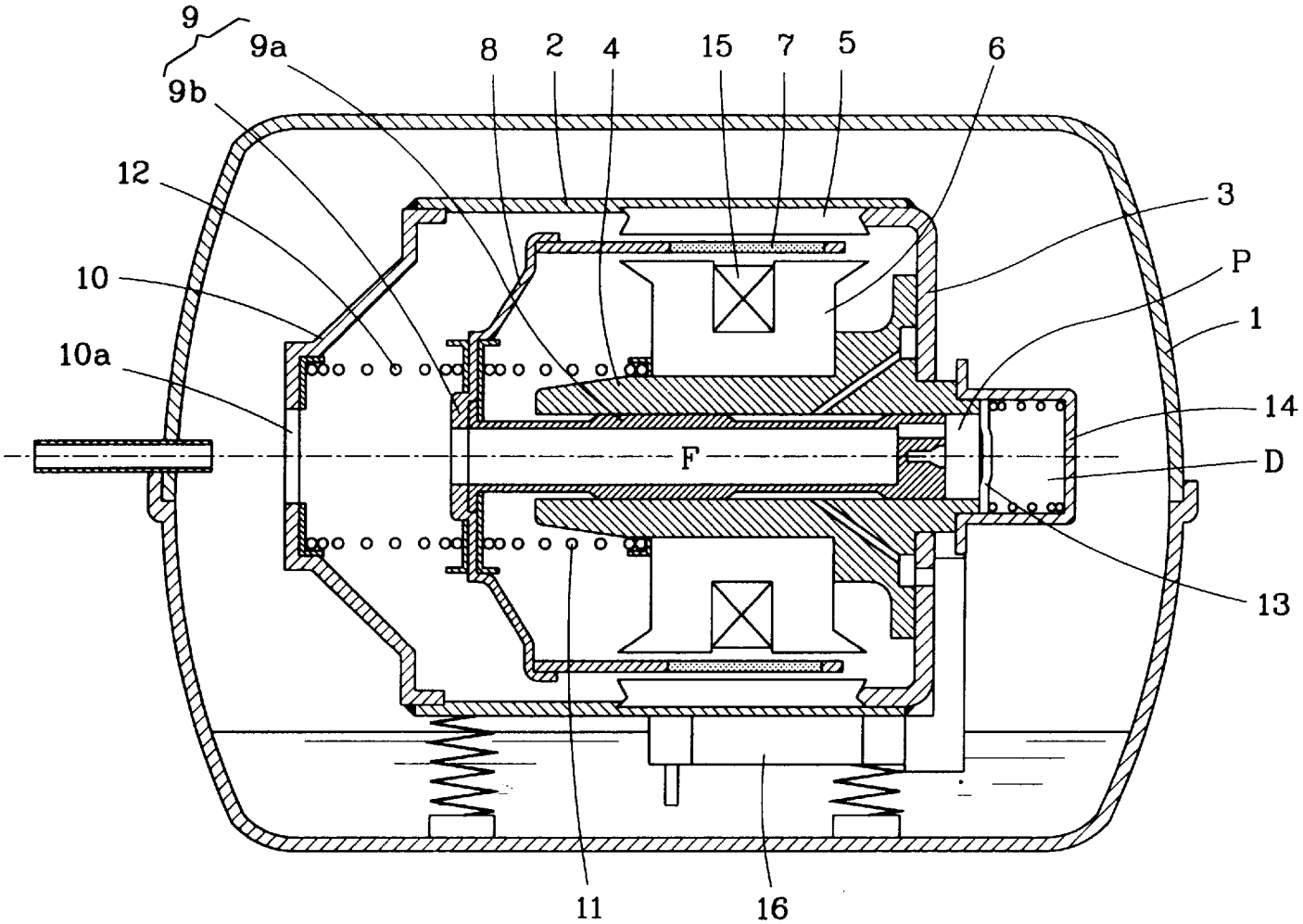
FIG. 1 CONVENTIONAL ART
FIG. 1 is a cross-sectional view illustrating the construction of a conventional linear compressor.
Figure 2:
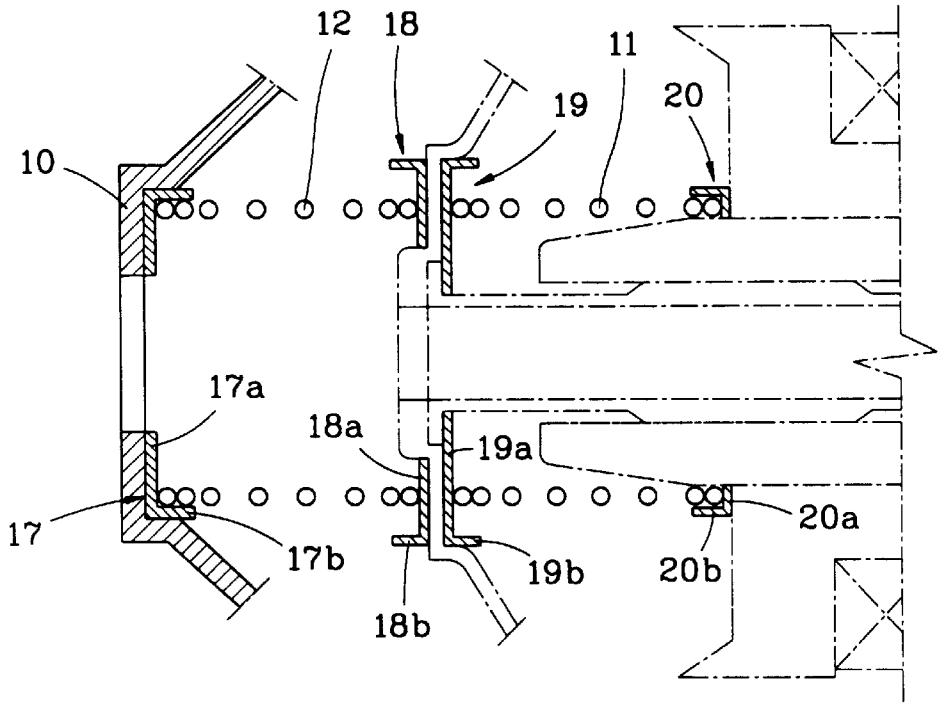
FIG. 2 CONVENTIONAL ART
FIG. 2 is a cross-sectional view illustrating a coil spring support structure for a conventional linear compressor.
Figure 3:
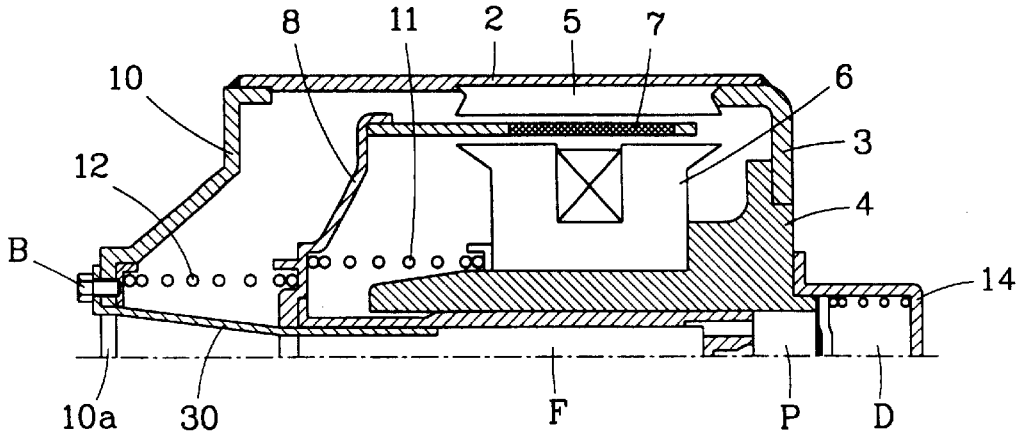
FIG. 3 CONVENTIONAL ART
FIG. 3 is a cross-sectional view illustrating a muffler coupling structure for a conventional linear compressor.
Figure 4A:
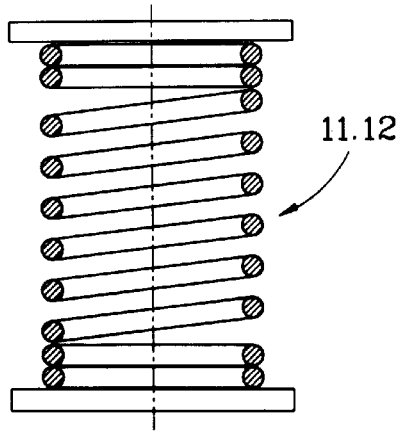
FIG. 4A CONVENTIONAL ART
FIG. 4A is a cross-sectional view illustrating the state of a coil spring before a compressor is operator in a conventional linear compressor.
Figure 4B:
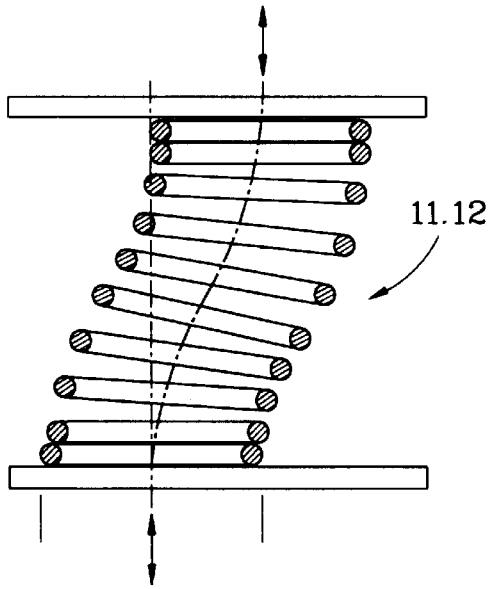
FIG. 4B CONVENTIONAL ART
FIG. 4B is a cross-sectional view illustrating the state of a coil spring when a compressor is operated in a conventional linear compressor.
Figure 5:
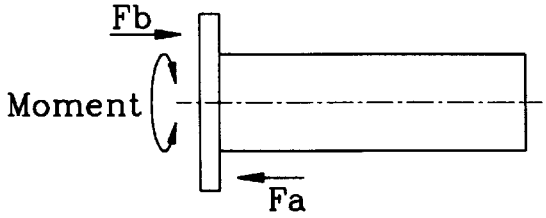
FIG. 5 CONVENTIONAL ART
FIG. 5 is a view illustrating the state that a rotation moment is generated by a piston by an eccentric state of a spring for a conventional linear compressor.
Figure 6:
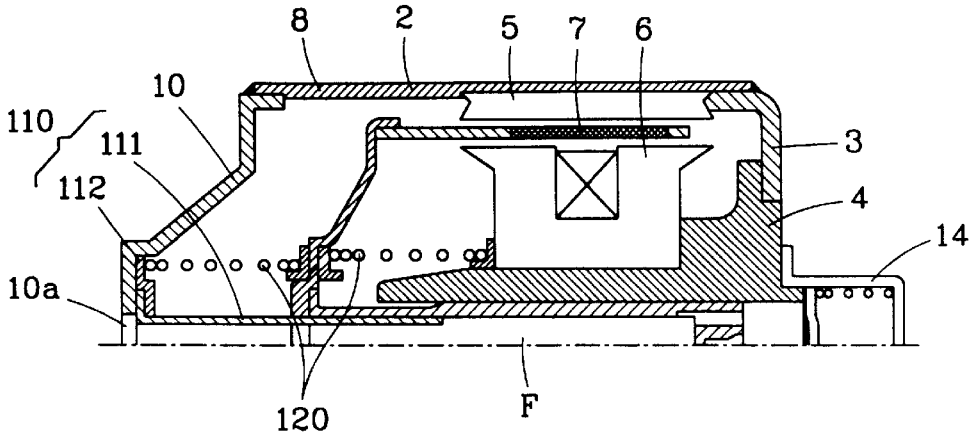
FIG. 6 is a cross-sectional view illustrating a muffler coupling structure for a linear compressor in which one muffler is installed according to the present invention.

The embodiments of the present invention will be explained with reference to the accompanying drawings.

First, the muffler coupling structure for a linear compressor according to the present invention includes a muffler having a hallow cylindrical inlet portion 111 and a contact surface 112 having a predetermined area formed as one end of the inlet portion 111 is vertically, outwardly curved, wherein one end of the inlet portion 111 is inserted into a gas flow path F of the piston 19, and the contact surface 112 of the other end of the same contacts with an inner surface of the cover 10. There is further provided an elastic support member 120 disposed between an inner surface of the cover 10 and one side of the inner lamination 6 for thereby supporting one end of the muffler 110.

Figure 7:
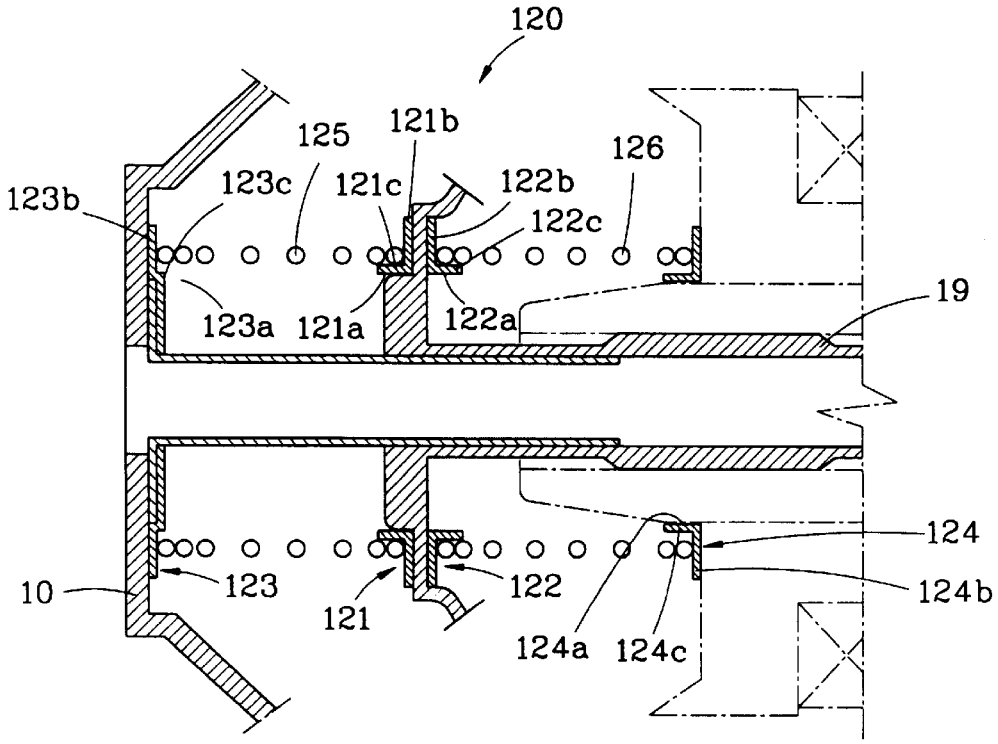
FIG. 7 is a cross-sectional view illustrating an elastic support member according to the present invention.
Figure 8:
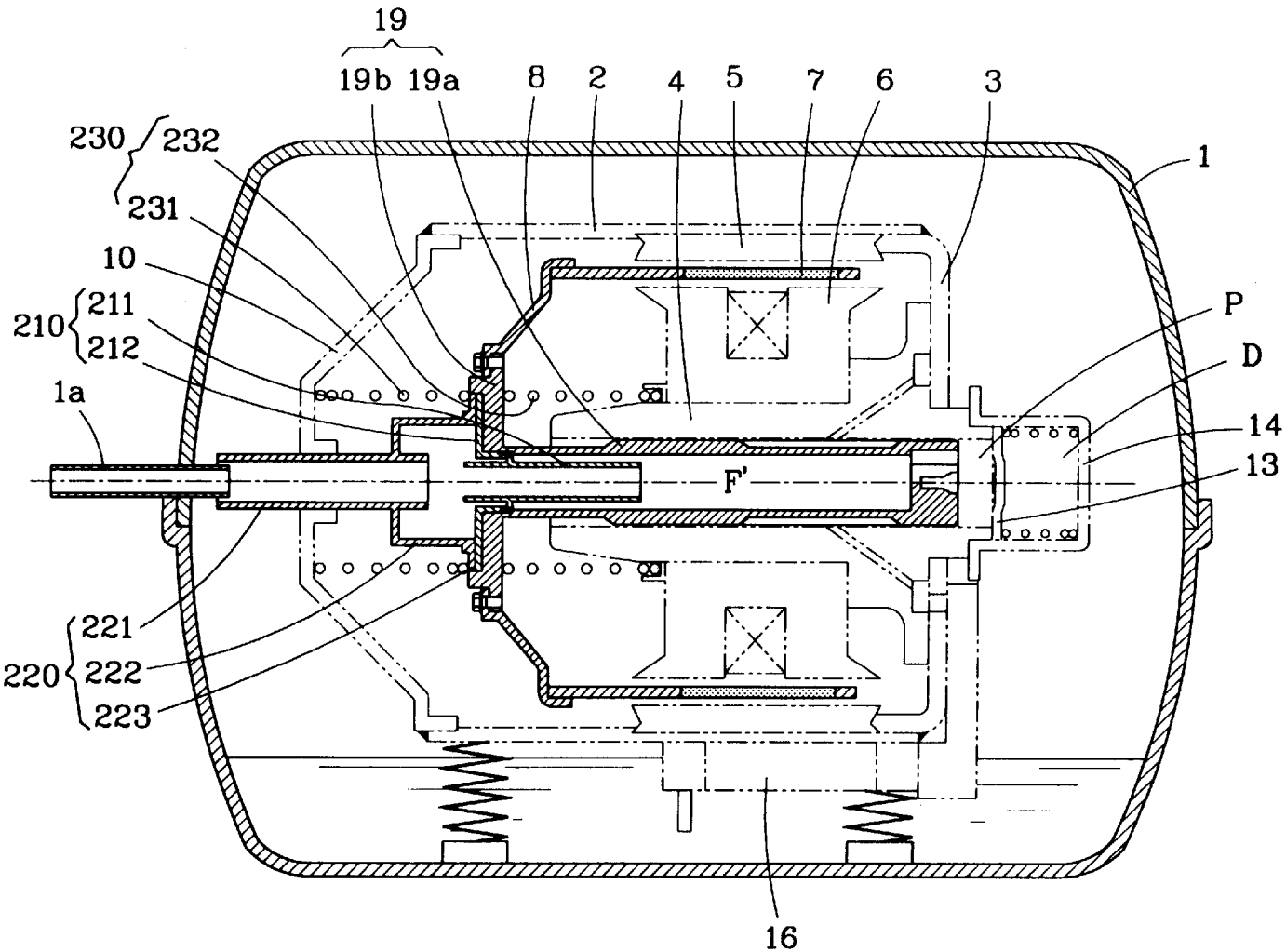
FIG. 8 is a cross-sectional view illustrating a muffler coupling structure for a linear compressor in which two mufflers are installed according to a first embodiment of the present invention.

As shown in FIG. 7, the elastic support member 120 includes first and second spring fixing support members 121 and 122 fixed to both surfaces of the piston 19, first and second spring support members 123 and 124 fixed to a surface of the inner lamination, a first spring 125 having its one end fixed to the first spring fixing support member 121 and its another end loosely supported by the first spring support member 123, and a second spring 126 having its one end fixed to the second spring fixing support member 122 and its another end loosely supported by the second spring support member 124.

The first and second spring fixing support members 121 and 122 respectively having a predetermined thickness and diameter are formed in a circular plate shape and include circular portions 121*b* and 122*b* having through holes 121*a* and 122*a* each having a predetermined diameter, and rim portions 121*c* and 122*c* vertically curved to have a predetermined height at the rim portions of the through holes 121*a* and 122*a* of the circular portions 121*b* and 122*b* and each having a predetermined inner diameter corresponding to the inner diameters of the first and second springs 125 and 126.

The first and second spring support members 123 and 124 are formed in a circular shape having a predetermined thickness and diameter and include circular portions 123*b* and 124*b* having through holes 123*a* and 124*a* each having a predetermined inner diameter, and rim portions 123*c* and 124*c* vertically curved to have a predetermined height at the rim portions of the through holes 123*a* and 124*a* of the circular portions 123*b* and 124*b* and each having a predetermined outer diameter smaller than the inner diameter of the first and second springs 125 and 126.

In the thusly constituted elastic support member 120, one end of the first spring 125 is inserted into the rim portion 121*c* of the first spring fixing support member 121 engaged to one surface of the piston 19, and the other end of the same is inserted into the rim portion 123*c* of the first spring support member 123 engaged with the inner surface of the cover 10.

In addition, one end of the second spring 126 is inserted into the rim portion 122*c* of the second spring fixing support member 122 having its one end engaged with the surface of the piston 19, and the other end of the same is inserted into the rim portion 124*c* of the second spring support member 124 engaged with the surface of the inner lamination 6 for thereby elastically supporting the piston 19, and the contact surface 112 of the muffler 110 contacting with the inner surface of the cover 10 is fixed to the piston 19.

The operation of the linear compressor having a muffler coupling structure according to the present invention will be explained with reference to the accompanying drawings.

Namely, in the linear compressor adapting the muffler coupling structure according to the present invention, as the electric power is supplied to the system, when the first magnet paddle 7 of the linear motor reciprocates between the inner lamination 6 and the outer lamination 5 at a high speed, the piston 19 connected with the second magnet paddle 8 reciprocates within the cylinder 4 at a high speed.

At this time, the refrigerant gas sucked through the suction tube 1*a* engaged with the hermetic container 1 is sucked into the interior of the compression space P of the cylinder 4 through the muffler 110, and the refrigerant gas sucked into the compression space P is compressed and exhausted through the exhaust valve assembly 13. The noise generated during the compression of the refrigerant gas is decreased by the muffler 110.

In addition, the contact surface 112 is fixed to the piston 19 by the elastic support member 120 elastically supporting the movement of the piston 19, so that the muffler 110 is fixed at the gas flow path F of the piston 19 without using an additional coupling member.

The first and second springs 125 and 126 which are elastically contracted and expanded during the reciprocating operation of the piston 19 each have its one end fixed to both surfaces of the piston 19, respectively, for thereby becoming integral with the piston 19, and its another end loosely supported by the first and second spring support members 123 and 124, respectively. Therefore, a predetermined variation does not occur in the radial directions of the first and second springs 125 and 126 during the reciprocating operation of the piston 19 for thereby elastically supporting the piston 19.

The muffler coupling structure for a linear compressor adapting two mufflers for increasing a noise decreasing effect according to a second embodiment of the present invention will be explained with reference to the accompanying drawings.

The muffler coupling structure for a linear compressor according to the second embodiment of the present invention includes a first muffler 210 having a hallow cylindrical inlet portion 211 and a first coupling portion 212 having a predetermined area defined as one end of the inlet 211 is vertically curved to contact with the support portion 19*b* of the piston 19, a second muffler 220 having a hallow cylindrical guide member 221 for guiding the gas sucked through the suction tube 1*a* engaged with the hermetic container 1 into the first muffler 210, a resonant tube member 222 expanded at the outer surface of the guide tube 221 and having a diameter larger than the diameter of the guide member 221, and a second coupling portion 223 having a predetermined area wherein the end portion of the resonant tube 222 is vertically curved, and wherein the second coupling portion 223 and the first coupling portion 212 of the first muffler 210 contact, and an elastic support member 230 for elastically supporting the movement of the piston 19 and fixing the first coupling portion 212 and the second coupling portion 223 to the support portion 19*b* of the piston 19.

The elastic support member 230 includes a first spring 231 disposed between an inner surface of the cover 10 and an outer surface of the piston 19, and a second spring 232 disposed between an inner surface of the piston 19 and a surface of the inner lamination 6. The first and second springs 231 and 232 each have end portions fixed to both surface of the piston 19, and other end portions loosely fixed to both surfaces of the piston 19.

The diameter of the guide portion 221 of the second muffler 220 is similar with the diameter of the inlet portion 211 of the first muffler 210. The area of the second coupling portion 223 of the second muffler 220 corresponds with the area of the first coupling portion 212 of the first muffler 210.

In the thusly constituted muffler coupling structure, the first muffler 210 is coupled in such a manner that the inlet portion 211 is inserted into the interior of the piston 19, namely, the gas flow path F, by contacting the first coupling portion 212 to the support portion 19*b* of the piston 19, and the second muffler 220 is coupled in such a manner that the end portion of the guide portion 221 is supported by the cover 10, and the second coupling portion 223 contacts with the first coupling portion 212 of the first muffler 210.

The elastic support member 230 supports the second coupling portion 223 of the second muffler 220, so that the mufflers 210 and 220 are fixed to the piston 19, respectively.

The operation of the muffler coupling structure for a linear compressor according to a second embodiment of the present invention will be explained with reference to the accompanying drawings.

The elements same as the conventional art are given the same reference numerals in the embodiments of the present invention.

When an electric power is supplied, and the piston 19 reciprocates within the cylinder 4. The refrigerant gas introduced through the suction tube 1*a* engaged with the hermetic container 1 is sucked into the interior of the cylinder 4 through the guide portion 221 of the second muffler 220 and the inlet portion 211 of the first muffler 210. The refrigerant gas sucked into the compression space P is compressed, and is exhausted through the exhaust valve assembly 13. The noises generated during the compression process of the refrigerant gas is decreased by the first and second mufflers 210 and 220.

In addition, the first muffler 210 and the second muffler 220 are fixed to the piston 19 by the elastic support member 230 in a state that the first coupling portion 212 and the second coupling portion 223 of the first and second mufflers 210 and 220 contact for thereby maintaining a stable coupling state and preventing a friction between the elements, so that the noise due to the friction between the elements is effectively prevented.

Figure 9:
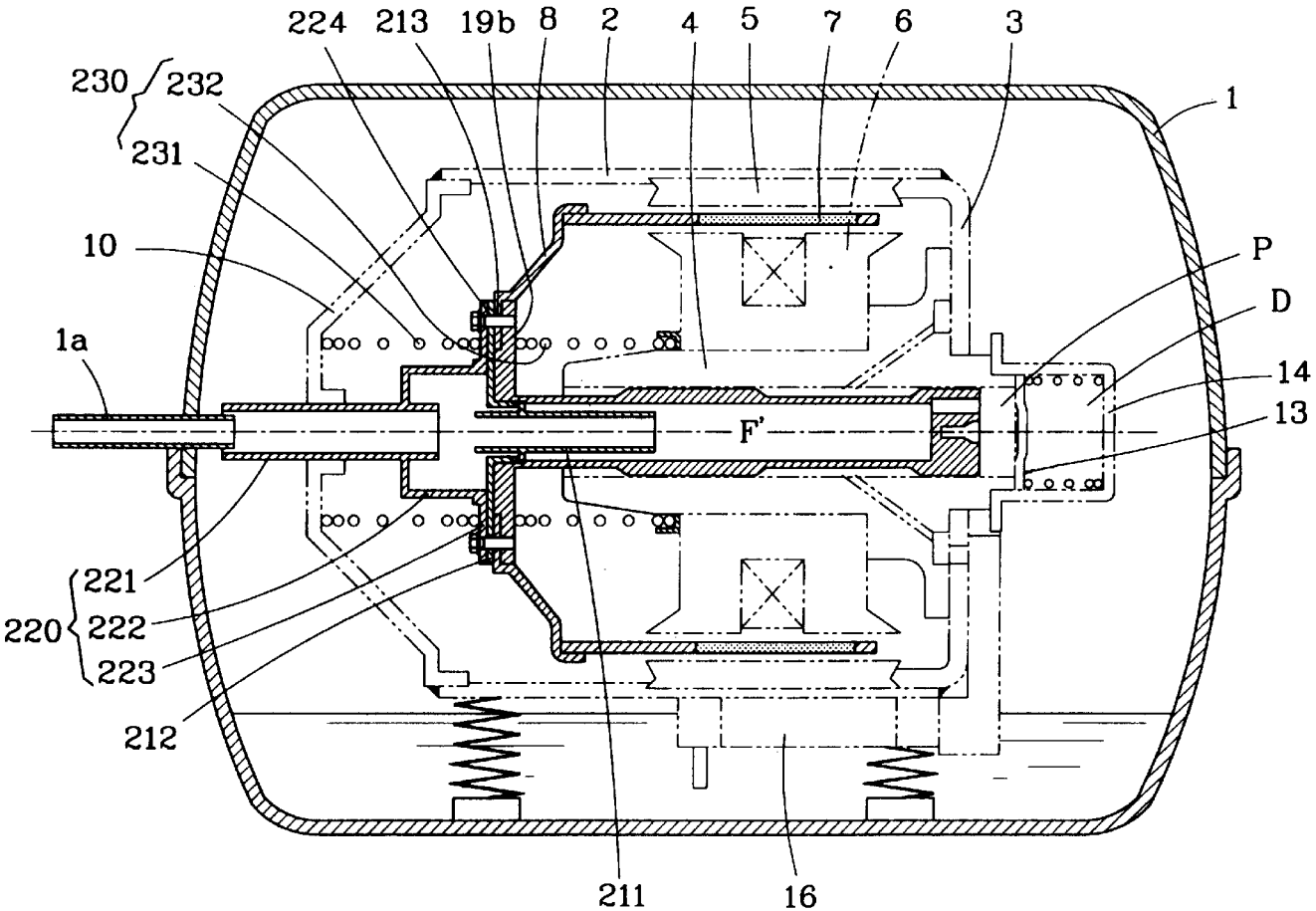
FIG. 9 is a cross-sectional view illustrating a muffler coupling structure for a linear compressor in which two mufflers are installed according to a second embodiment of the present invention.

In addition, as shown in FIG. 9, in the two-muffler coupling structure according to the present invention, a plurality of first screw holes 213 are formed on the extended surface of the first coupling portion 212 formed to have a predetermined area as the end portion of the inlet portion 211 of the first muffler 210 is vertically curved, and a plurality of second screw holes 224 are formed at the portion corresponding to the first screw holes 213 of the extended surface of the second coupling portion 223 formed to have a predetermined area as the end portion of the resonant portion 222 of the second muffler 220 is vertically curved.

The first screws 213 are formed at the portion corresponding to the coupling hole (not shown) formed at the second magnet paddle 8 and the support portion 19*b* of the piston 19.

In the above-described embodiment of the present invention, in the first muffler 210, the first screw hole 213 is aligned with the coupling hole formed at the second magnet paddle 8 and the support portion 19*b* of the piston for thereby contacting the first coupling portion 212 with the support portion 19*b* of the piston. In addition, in the second muffler 220, one side of the guide portion 221 is supported by the cover 10, and the second screw hole 224 of the second coupling portion 223 is aligned with the first screw hole 213 of the first muffler 210, and the coupling bolt for coupling the second magnet paddle 8 and the piston 19 is inserted into the first and second screw holes 213 and 224 and the coupling hole, respectively, for thereby coupling the first and second mufflers 210 and 220 to the piston 19.

Figure 10:
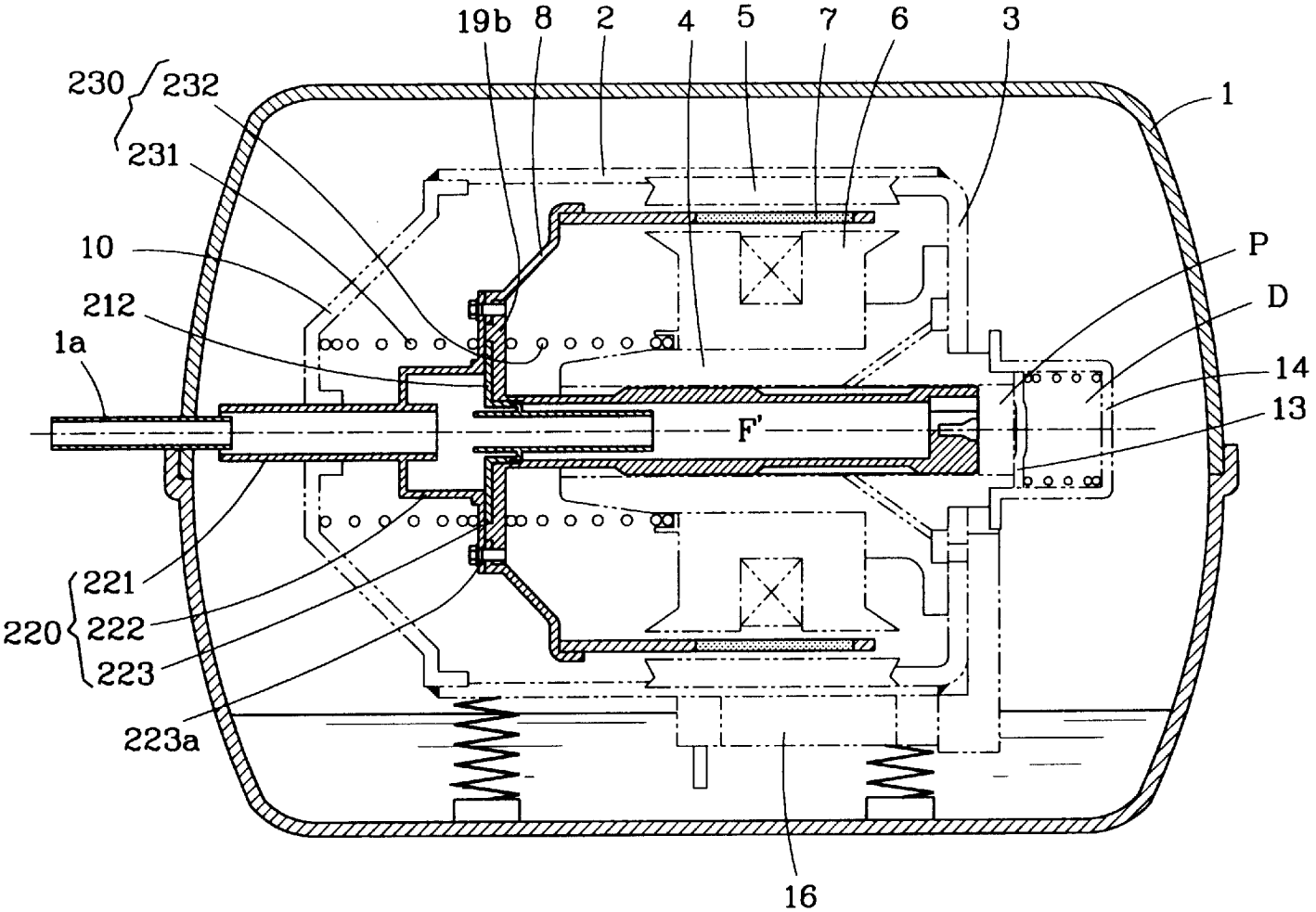
FIG. 10 is a cross-sectional view illustrating a muffler coupling structure for a linear compressor in which two mufflers are installed according to a third embodiment of the present invention.

In addition, as shown in FIG. 10, in the two-muffler coupling structure according to the present invention, the second coupling portion 223 of the second muffler 220 is formed to have an area larger than that of the first coupling portion 212 of the first muffler 210, and a plurality of screw holes 223*a* are formed on the extended surfaces.

The screw holes 223*a* are formed at the portion corresponding to the coupling holes formed at the second magnet paddle 8 and the support portion 19*b* of the piston 19.

In the above-described embodiment of the present invention, the first muffler 210 is inserted into the gas flow path F in a state that the first coupling portion 212 contacts with the support portion 19*b* of the piston 19, and in the second muffler 220, one side of the guide portion 221 is supported by the cover 10, and the screw holes 223*a* formed at the second coupling portion 223 are aligned with the coupling holes formed at the second magnet paddle 8 and the piston 19, and the coupling bolt for coupling the second magnet paddle 8 and the piston 19 is inserted into the screw hole 223*a* and the coupling hole for thereby stably coupling the first and second mufflers 210 and 220 to the piston 19.

In the above-described embodiment of the present invention, since the first and second mufflers 210 and 220 are stably coupled to the piston 19 by the coupling bolt which is used for coupling the second magnet paddle 8 and the piston 19, it is possible to prevent any friction between the elements when the piston 19 reciprocates for thereby preventing a noise due to the friction between the elements.

Since the construction and operation of the elastic support member which supports the mufflers and the piston 19 and elastically supports the piston 19 when the piston 19 reciprocates is the same as the first embodiment of the present invention, the descriptions of the same will be omitted.

As described above, in the muffler coupling structure for a linear compressor according to the present invention, the muffler may be stably fixed to the piston using a spring which elastically supports the piston when the piston reciprocates without additionally using the coupling member.

In addition, in the muffler coupling structure according to the present invention, even when two mufflers are installed in the linear compressor, it is possible to stably fix two mufflers to the piston for thereby preventing a friction noise between the elements, so that a reliability of the product is increased, and an easier fabrication and assembling process are implemented for thereby significantly increasing the productivity.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A muffler coupling structure for a linear compressor, comprising:

a muffler including:

a hollow cylindrical inlet portion;

a contact portion having a predetermined area wherein one end of the inlet portion is outwardly and vertically curved, whereby one end of the inlet portion is inserted into a gas flow path of a piston, and one end of the contact portion contacts with an inner surface of the cover;

an elastic support means disposed between an inner surface of the cover and a side surface of an inner lamination for supporting one end of the muffler;

wherein said elastic support means includes:

first and second spring fixing support members fixed to both sides of the piston;

first and second spring support members fixed to an inner center portion of the cover and a side surface of the inner lamination; and first and second springs disposed between the first and second spring fixing support members and the first and second support members;

wherein said first and second fixing support members includes:

circular portions each formed of a circular plate having a predetermined thickness and diameter and having through holes each having a predetermined diameter; and rim portions vertically curved to have a predetermined height at the rim portions of the through holes of the circular portions and each having an outer diameter corresponding to each of the inner diameters of the first and second springs.

2. A muffler coupling structure for a linear compressor, comprising:

a muffler including:

a hollow cylindrical inlet portion;

a contact portion having a predetermined area wherein one end of the inlet portion is outwardly and vertically curved, whereby one end of the inlet portion is inserted into a gas flow path of a piston, and one end of the contact portion contacts with an inner surface of the cover;

an elastic support means disposed between an inner surface of the cover and a side surface of an inner lamination for supporting one end of the muffler;

wherein said elastic support means includes:

first and second spring fixing support members fixed to both sides of the piston;

first and second spring support members fixed to an inner center portion of the cover and a side surface of the inner lamination; and first and second springs disposed between the first and second spring fixing support members and the first and second support members;

wherein said first and second support members includes:

circular portions each formed of a circular plate having a predetermined thickness and diameter and having through holes each having a predetermined inner diameter; and rim portions vertically curved to have a predetermined height at the rim portions of the through holes of the circular portions and each having an outer diameter smaller than each of the inner diameters of the first and second springs.

3. A muffler coupling structure for a linear compressor, comprising:

a muffler including:

a hollow cylindrical inlet portion;

a contact portion having a predetermined area wherein one end of the inlet portion is outwardly and vertically curved, whereby one end of the inlet portion is inserted into a gas flow path of a piston, and one end of the contact portion contacts with an inner surface of the cover;

an elastic support means disposed between an inner surface of the cover and a side surface of an inner lamination for supporting one end of the muffler;

wherein said elastic support means includes:

first and second spring fixing support members fixed to both sides of the piston;

first and second spring support members fixed to an inner center portion of the cover and a side surface of the inner lamination; and first and second springs disposed between the first and second spring fixing support members and the first and second support members;

wherein said first spring has its one end inserted into the rim portion of the first spring fixing support member engaged with a surface of the piston, and its other end loosely inserted into the rim portion of the first spring support member engaged with an inner surface of the cover.

4. A muffler coupling structure for a linear compressor, comprising:

a muffler including:

a hallow cylindrical inlet portion;

a contact portion having a predetermined area wherein one end of the inlet portion is outwardly and vertically curved, whereby one end of the inlet portion is inserted into a gas flow path of a piston, and one end of the contact portion contacts with an inner surface of the cover;

an elastic support means disposed between an inner surface of the cover and a side surface of an inner lamination for supporting one end of the muffler;

wherein said elastic support means includes:

first and second spring fixing support members fixed to both sides of the piston;

first and second spring support members fixed to an inner center portion of the cover and a side surface of the inner lamination; and first and second springs disposed between the first and second spring fixing support members and the first and second support members;

wherein said second spring has its one end inserted into the rim portion of the second spring fixing support member engaged with the other surface of the piston, and its other end loosely inserted into the rim portion of the second spring support member engaged with a surface of the inner lamination.

5. A muffler coupling structure for a linear compressor, comprising:

a muffler including:

a hallow cylindrical inlet portion;

a contact portion having a predetermined area wherein one end of the inlet portion is outwardly and vertically curved, whereby one end of the inlet portion is inserted into a gas flow path of a piston, and one end of the contact portion contacts with an inner surface of the cover;

an elastic support means disposed between an inner surface of the cover and a side surface of an inner lamination for supporting one end of the muffler;

wherein said elastic support means elastically supports the piston when the piston reciprocates and fixes the muffler to the piston.

6. A muffler coupling structure for a linear compressor comprising:

a first muffler inserted into a gas flow path of a piston;

a second muffler engaged with a cover; and an elastic support means for elastically supporting the movement of the piston and fixing the first and second coupling portions of first and second mufflers to a support portion of the piston.

7. The structure of claim 6, wherein said first muffler includes:

a hallow cylindrical inlet portion; and a first coupling portion having a predetermined area wherein one end of the inlet portion is vertically curved.

8. The structure of claim 6, wherein said second muffler includes:

a hallow cylindrical guide portion;

a resonant portion having a portion expanded to have a diameter larger than the diameter of the guide portion at an outer circumferential surface of the guide portion; and a second coupling portion having a predetermined area wherein one end of the resonant portion is vertically curved.

9. The structure of claim 6, wherein said elastic support means includes:

a first spring disposed between an inner surface of the cover and an outer surface of the piston; and a second spring disposed between an inner surface of the piston and a surface of the inner lamination.

10. The structure of claim 9, wherein each of said first and second springs has its one end fixed to both sides of the piston, and its other end which is loosely supported.

11. The structure of claim 8, wherein the diameter of the guide portion of the second muffler corresponds to the diameter of the inner portion of the first muffler.

12. The structure of claim 8, wherein said second coupling portion contacts with the first coupling portion of the first muffler.

13. The structure of claim 12, wherein the area of the second coupling portion of the second muffler corresponds to the area of the first coupling portion of the first muffler.

14. The structure of claim 7, wherein in said first muffler, a plurality of first screw holes are formed on an extended surface of the first coupling portion.

15. The structure of claim 14, wherein said first screw holes each are formed at a portion corresponding to the engaging holes formed at the second magnet paddle and the support portion of the piston.

16. The structure of claim 8, wherein in said second muffler, a plurality of second screw holes are formed at a portion corresponding to the first screw holes of the extended surface of the second coupling portion.

17. The structure of claim 8, wherein in said second muffler, the area of the second coupling portion is larger than the area of the first coupling portion of the first muffler, and a plurality of screw holes are formed on the extended surface.

18. The structure of claim 17, wherein said screw holes are formed at the portion corresponding to the coupling holes formed at the second magnet paddle and the support portion of the piston.

* * * * *